US011053685B1

(12) United States Patent
McDonough et al.

(10) Patent No.: US 11,053,685 B1
(45) Date of Patent: Jul. 6, 2021

(54) SLATE OR TILE SHINGLE AND METHOD OF HANGING A SHINGLE TO A ROOF USING A NAIL GUN

(71) Applicants: Michael J. McDonough, Lakewood, CO (US); Jonathan Hill, Poultney, VT (US)

(72) Inventors: Michael J. McDonough, Lakewood, CO (US); Jonathan Hill, Poultney, VT (US)

( * ) Notice: Subject to any disclaimer, the term of this patent is extended or adjusted under 35 U.S.C. 154(b) by 0 days.

(21) Appl. No.: 16/364,420

(22) Filed: Mar. 26, 2019

Related U.S. Application Data

(60) Provisional application No. 62/649,152, filed on Mar. 28, 2018.

(51) Int. Cl.

| | |
|---|---|
| ***E04D 1/34*** | (2006.01) |
| ***E04D 1/14*** | (2006.01) |
| ***E04D 1/16*** | (2006.01) |
| ***E04D 1/20*** | (2006.01) |
| ***E04D 1/22*** | (2006.01) |

(52) U.S. Cl.
CPC ..... *E04D 1/34* (2013.01); *E04D 1/14* (2013.01); *E04D 1/16* (2013.01); *E04D 1/20* (2013.01); *E04D 1/22* (2013.01); *E04D 2001/3423* (2013.01); *E04D 2001/3467* (2013.01); *E04D 2001/3473* (2013.01); *E04D 2001/3494* (2013.01)

(58) Field of Classification Search
CPC .... E04D 1/34; E04D 1/14; E04D 1/16; E04D 1/20; E04D 1/22; E04D 2001/3423; E04D 2001/3467; E04D 2001/3473; E04D 2001/3494
USPC ..... 52/543
See application file for complete search history.

(56) References Cited

U.S. PATENT DOCUMENTS

| | | | | |
|---|---|---|---|---|
| 1,018,524 A * | 2/1912 | Smiley | E04D 5/10 | 52/545 |
| 1,666,939 A * | 4/1928 | Lietz | E04D 1/125 | 52/532 |
| 2,044,781 A * | 6/1936 | Harshberger | E04D 1/28 | 52/543 |

(Continued)

FOREIGN PATENT DOCUMENTS

| | | |
|---|---|---|
| DE | 4423384 | 1/1995 |
| GB | 191015872 A | 7/1910 |

(Continued)

OTHER PUBLICATIONS

"Slate Roofing-Installation Manual, Fifth Edition," North Country Slate, 2006, retrieved from http://www.ncslate.com/pdf/NCS-Slate-Rooling-installation-Manual-Fifth-Edition.pdf on Jun. 19, 2019, pp. 395-432.

(Continued)

*Primary Examiner* — Patrick J Maestri
*Assistant Examiner* — Joseph J. Sadlon
(74) *Attorney, Agent, or Firm* — Sheridan Ross P.C.

(57) ABSTRACT

A shingle and a method of hanging the shingle by a fastener driven by a nail gun. The shingle can be formed from slate or made of clay, ceramic, glass, or concrete. The shingle includes at least one aperture for a fastener. The aperture is spaced a predetermined distance from an upper end of the shingle.

18 Claims, 3 Drawing Sheets

(56) References Cited

U.S. PATENT DOCUMENTS 2,094,188 A * 9/1937 Phelan ..... E04D 1/16 52/470
4,914,885 A 4/1990 Baker et al.
5,094,058 A * 3/1992 Slocum ..... B29C 43/222 52/533
5,593,079 A 1/1997 Mukoyama et al.
5,617,690 A 4/1997 Gibbs
5,711,126 A * 1/1998 Wells ..... E04D 1/30 52/519
5,791,112 A * 8/1998 Plum ..... E04D 12/002 52/551
5,873,510 A 2/1999 Hirai et al.
5,895,536 A * 4/1999 Starr ..... E04D 1/34 156/71
6,067,766 A * 5/2000 Badke ..... B27B 31/003 52/518
6,148,578 A * 11/2000 Nowacek ..... E04D 1/14 52/105
6,164,034 A * 12/2000 Roetheli ..... E04D 1/085 428/292.4
6,178,703 B1 * 1/2001 Noone ..... E04D 1/16 52/100
6,253,512 B1 * 7/2001 Thompson ..... E04D 1/14 52/311.1
6,277,024 B1 * 8/2001 Coulton ..... F24F 7/02 454/365
6,367,221 B1 * 4/2002 Elliott ..... E04D 1/26 52/519
6,516,572 B1 2/2003 Nowacek et al.
6,783,045 B2 8/2004 Shima et al.
6,874,289 B2 * 4/2005 Koch ..... E04D 1/26 52/543
6,929,165 B1 8/2005 Chen et al.
7,448,177 B2 * 11/2008 McClintick ..... E04D 1/14 52/551
7,475,516 B2 * 1/2009 Jolitz ..... E04D 1/205 52/105
7,578,108 B2 * 8/2009 Swanson ..... E04D 1/26 156/71
7,716,894 B2 * 5/2010 Jolitz ..... E04D 1/3405 52/535
8,136,322 B2 * 3/2012 Shadwell ..... E04D 1/205 52/518
8,297,020 B1 * 10/2012 Swanson ..... E04D 1/26 52/540
8,550,324 B2 10/2013 Coleman
8,677,710 B2 * 3/2014 Williams ..... E04D 1/34 52/551
D755,997 S 5/2016 Frey et al.
9,416,540 B2 * 8/2016 Allen ..... E04D 1/20
10,094,113 B2 * 10/2018 Hill ..... E04B 1/80
10,358,824 B2 * 7/2019 Aschenbeck ..... E04D 1/29
10,829,937 B2 * 11/2020 Whitridge, Jr. ..... E04D 1/12
2006/0053740 A1 * 3/2006 Wilson ..... E04F 13/0864 52/745.09
2006/0059832 A1 3/2006 McClintick
2008/0005994 A1 * 1/2008 Harney ..... E04F 13/0864 52/543
2013/0025224 A1 * 1/2013 Vermilion ..... E04D 1/26 52/309.2
2013/0031864 A1 * 2/2013 Schools ..... E04D 1/16 52/519
2017/0058527 A1 3/2017 Williams et al.

FOREIGN PATENT DOCUMENTS

GB 120454 11/1917
GB 126589 1/1919
GB 2277540 4/1993
GB 2335670 9/1999
WO WO 01/65024 9/2001

OTHER PUBLICATIONS

Hall, "Synthetic Slate Roofing for Churches," Traditional Building, Sep. 28, 2017, retrieved from https://www.traditionalbuilding.com/product-report/synthetic-slate-roofing on Jun. 19, 2019, 3 pages.

* cited by examiner

SLATE OR TILE SHINGLE AND METHOD OF HANGING A SHINGLE TO A ROOF USING A NAIL GUN

CROSS-REFERENCE TO RELATED APPLICATIONS

This application claims priority under 35 U.S.C. § 119(e) to U.S. Provisional Patent Application Ser. No. 62/649,152 filed Mar. 28, 2018, which is incorporated herein in its entirety by reference.

FIELD

The present disclosure relates to a shingle and systems and methods of installing a shingle on a building. More specifically, the present disclosure relates to a shingle adapted to be affixed to a roof with a fastener driven by an automatic means, such as a nail gun.

BACKGROUND

Shingles formed of slate or tile are durable and, when installed on a roof, last a long time. However, shingles formed from slate or made of ceramic, clay, glass, or concrete are fragile. Fasteners used to fix the shingle to a roof deck frequently crack or otherwise damage the shingle. More specifically, and referring now to FIGS. 1-3, current methods of installing shingles 6 on a roof deck 2 include placing fasteners 14 through holes formed from one-fourth to one-third from an upper end 8 of the shingle. See, The National Roofing Contractors Associate (NRCA) Roofing and Waterproofing Manual-Fifth Edition, at page 413 (hereinafter "the NCRA roofing manual"). The NCRA roofing manual is reprinted at: ncslate.com/pdf/NCS-Slate-Roofing-Installation-Manual-Fifth-Edition.pdf and is incorporated herein by reference in its entirety. When arranged in courses 4A, 4B, 4C, on a roof, the shingles 6 of each course overlap. More specifically, an upper end 8 of a shingle 6 contacts the roof deck 2 while a lower end 10 extends above shingles 6 of one or two lower courses 4. The lower end 10 of a shingle is cantilevered above two lower shingles. The upper end 8 of the lower shingle forms a fulcrum upon which a portion of the upper shingle rests.

On prior art roofs, the length of the slate tiles or shingle 6 is the exposure 5 multiplied by two, plus about three inches. For example, typical prior art slate tiles or shingles 6 are 9 inches by 18 inches, which gives an effective exposure 5 of about 7.5 inches.

Fasteners 14 are driven by hand to secure the shingles 6 to the roof deck, a very time consuming and difficult process. The roofer must simultaneously hold the shingle 6 in position, place and hold the fastener 14 in its pre-formed hole, and drive the fastener with a hammer. The roofer has to "feel the nail" is seated properly and ensure that only the nail head is struck and not the slate shingle 6.

If a fastener 14 is driven too far into the roof deck, the fastener 14 may break or fracture the shingle 6. For example, the head of the fastener 14 may apply a force to the shingle such that an unsupported portion of the shingle is in tension until the shingle cracks or breaks. A glass or slate shingle 6 that is hit by the hammer will result in the slate being damaged or broken. Once damaged or broken, the shingle must be replaced which requires a significant amount of extra time. Experience and coordination are limiting factors when installing hand-driven nails.

While a variety of fastener types can be used with slate shingles 6, such as copper slating nails, stainless steel, bronze or cut-brass roofing nails, the NRCA suggests the use of copper slating nails for slate roofs. Unprotected black-iron and electroplated nails are not recommended. One benefit of using copper nails is that the shank of a copper slating nail can be easily cut with a slate ripper when repair work is needed. Unfortunately, the shank of a copper nail or a bronze nail is very soft and easily bent or damaged increasing the difficult of manually driving a fastener 14 into the roof deck.

Referring now to FIG. 2, because the holes for the fasteners 14 are spaced a significant distance away from the upper end 8 of the shingles 6, fasteners are driven through the shingles 6 at a position where a lower surface 12 of each shingle 6 is spaced from the roof deck 2 and at least a portion of the shingle lower surface 12 is not supported. An air gap 18 exists between the shingle 6 and roof deck 2 proximate to the fastener 14. The air gap has a height which is equal to the thickness 16 of the thicker of two shingles 6 over which the shingle laps. For example, as shown in FIG. 1, shingle 6F overlaps shingles 6D and 6E. Further, as shown in FIG. 3, shingle 6D is thicker than shingle 6E. Accordingly, as illustrated in FIG. 2, for this example the air gap 18A between the lower surface 12 of shingle 6F and the roof deck 2 is equal to the thickness of shingle 6D. Because the hole for the fastener 14 for prior art slate shingles 6F is spaced up to ⅓ of the length of the slate from the shingle upper end 8, the hole is at or near a point where the air gap 18A has its greatest height. The slate shingle 6 must absorb any shock received from the fastener and the hammer rather than dispersing the force to lower shingles or the roof deck.

Referring now to FIG. 3, natural slate shingles 6 are hand split. Because slate shingles 6 are not machined to a uniform thickness 16, slate shingles delivered to a job site will have a variety of different thicknesses. Additionally, slate shingles 6 have upper and lower surfaces 11, 12 that are textured or uneven (not illustrated for clarity). Within the acceptable thickness range associated with shingles having a specified thickness 16 of ¼"-⅜", a variance of ⅛" is allowed. These variations cause air gaps 18 between upper 11 and lower 12 surfaces of overlapping shingles 6. In some cases, the air gap 18 may be equal to the thickness of the thickest of two adjacent slate shingles. For example, when a slate shingle 6B with a thickness 16 of ¼" is laid next to a slate shingle 6C with a thickness of ⅜" and then lapped by slate shingle 6E with a ¼" thickness, the shingles 6B, 6C, 6E do not sit evenly and an uneven air gap 18B is created at the lap point. The air gap 18B is equal to the difference between the thickness of the slate shingles 6B, 6C, or ⅛" in this example.

The surfaces irregularities and thickness variations prevent slate shingles 6 from sitting evenly upon one another. Slate shingles 6 laid in a horizontal sequence will create an undulating surface for each course 4A, 4B rather than a flat substrate for a subsequent course 4C. Each subsequent vertical course 4 lapped upon the previous course will compound the irregularities. For example, shingle 6G overlaps two shingles that are thinner than the shingles overlapped by shingle 6F. Accordingly, the upper surface 11 of shingle 6G is lower than the upper surface 11 of shingle 6F.

The air gaps 18 cause many problems when driving fasteners 14, such as nails, into the roof deck 2. An air gap between a slate shingle and the roof deck 2 prevents the shingle from distributing force received from a hammer or a fastener to the roof. Thus, a glass or slate shingle 6 incidentally struck by a hammer is more likely to be damaged compared to a shingle with a lower surface 12 supported by the roof deck.

The air gap may also cause the shingle to rock or pivot as the fasteners are driven through the shingle into the roof deck. More specifically, and referring again to FIG. 3, if a first fastener is driven through a hole proximate to the left edge of slate shingle 6E, shingle 6E may pivot counterclockwise toward shingle 6B. When a second fastener is driven through a hole proximate to the right edge of the slate shingle 6E, the left edge of shingle 6C may serve as a fulcrum causing the shingle 6E to fracture.

Another problem caused by air gaps is that the fasteners 14 must have a length sufficient to account for the air gap 18 between the shingle and the roof deck. Accordingly, fasteners 14 generally have a length which is twice the shingle thickness plus an additional inch. For prior art shingles 6 with a thickness between ¼" and ⅜", the fastener is 1¾" long. The additional length of the shank required by the air gap, and the variable thickness of the airgaps, means that some fasteners are longer than required, such as when an air gap is small. This necessitates driving the fastener shank further into the roof deck to properly seat the nail head with respect to the slate shingle 6. As one of skill in the air will appreciate, to drive the fastener further, more force is required, increasing the chance of damaging the slate shingle or bending the fastener (especially if a copper or bronze fastener is used).

As one of skill in the art will appreciate, installing shingles 6 on a roof with fasteners driven by a nail gun would require significantly less labor and time than a roof installed using manually driven fasteners. Unfortunately, nail guns frequently overdrive fasteners. Known nail guns do not have sufficient depth control to be used with prior art slate shingles 6 and fasteners driven by the nail guns apply too much force to the shingles. This may not be a problem in some applications, such as when a nail gun is used to install asphalt shingles which are pliable. But, as described above, a fastener 14 which is overdriven with respect to a slate shingle 6 can fracture or break the shingle. Because of the limitations of prior art slate and tile shingles 6, the shingles must be installed on roofs manually by experienced craftsman.

Several attempts have been made to decrease the labor required to install slate or tile shingles. For example, German Patent Publication DE 4423384 (application DE19944423384) by Klaus Flosbach, which is incorporated herein by reference in its entirety, describes a slate tile with very large holes configured to receive inserts that are pressure and impact resistant. A fastener is then driven through the insert to affix the tile to roof.

U.S. Pat. No. 5,617,690 to Gibbs teaches the use of mounting assemblies for attaching slate tile to a roof deck or wall. The '690 patent is incorporated herein by reference in its entirety.

In U.S. Patent App. Pub. 2006/0059832 by McClintick, which is also incorporated herein by reference in its entirety, a system of battens and hangers is described which may be used to attach slates to a roof. The slate tiles are hung from hooks of the hangers rather than by fasteners driven through the slate tiles.

Another system of installing a slate roof is described in U.S. Patent App. Pub. 2017/0058527 by Williams. The '527 publication, which is incorporated herein by reference in its entirety, generally describes a fastener formed of wire. The fastener includes a hook which receives a lower edge of a slate tile to secure the slate tile to the roof.

There is a need for a tile or shingle formed from glass, slate or tile that can be affixed to a roof by a fastener driven through an aperture in the shingle using a nail gun as well as a nail gun configured to drive a fastener through a glass, slate or tile shingle.

SUMMARY

Embodiments of the present disclosure contemplate a novel shingle and a method and apparatus of hanging a shingle on a roof. The shingle is configured to be hung on a roof by a fastener driven through an aperture by an automatic driving means, such as a nail gun. The systems, methods, and apparatus of the present disclosure reduce installation time of a shingle roof by approximately 50% when installed with an automatic driving means compared to the time required to manually install a roof with prior art shingles of similar material.

One aspect of the present disclosure is a shingle. The shingle can be formed from slate or made of clay, ceramic, glass, concrete, wood, and similar materials. Apertures to receive fasteners are formed through the shingle. The apertures are spaced a predetermined distance from an upper end of the shingle. In one embodiment, the apertures are formed no more than approximately 3 inches from the upper end. In another embodiment, the apertures are between approximately 1.75 inches and approximately 2.75 inches from the upper end. In still another embodiment, the apertures are formed less than approximately 2.5 inches from the upper end. In one embodiment, the spacing of the apertures from the upper end of the shingle does not change regardless of the length of the shingle. Accordingly, shingles with a length of from approximately 8 inches to approximately 14 inches will have apertures spaced the predetermined distance from an upper end.

The apertures can be formed by any suitable means. In one embodiment, the apertures are formed by drilling through the shingle. Alternatively, the apertures can be punched through the shingle. To form the apertures, the shingle is positioned on a work-surface that is generally planar. The work-surface includes a hole aligned with a punch or drill-bit used to form the aperture in the shingle. The hole receives waste from the aperture formed in the shingle. At least two apertures are formed through the shingle. In one embodiment, the apertures are formed sequentially, reducing the shock transmitted to the shingle, as simultaneously forming the apertures can damage the shingle.

In one embodiment, the shingle has a thickness of less than approximately 0.8 inches. In another embodiment, the thickness of the shingle is between approximately 0.125 inches and approximately 0.5 inches. More specifically, the thickness of the shingle is between approximately 0.25 inches and approximately 0.375 inches plus or minus approximately 0.125 inches.

The shingle improves the productivity of installers and reduces labor costs associated with installing the shingle on a roof. Labor costs are decreased because an automatic driving means, such as a nail gun, can be used to drive fasteners through the apertures. As a result, a roof comprising shingles of the present disclosure may be installed at least about 40% faster.

Another aspect of the present disclosure is a roof having a plurality of shingles fixed to the roof by fasteners driven by an automatic fastener driver. The roof generally comprises at least a first interlayment underlying a first course of shingles. Shingles of the first course of shingles include apertures through the shingles. The apertures are formed no more than approximately 3 inches from an upper end of the shingles. The shingles of the first course are positioned above the first interlayment such that lower ends of the shingles are substantially flush with a lower end of the first interlayment. Fasteners driven through the apertures affix the shingles to the roof, the fasteners having been driven by a nail gun or the like.

Another aspect of the present disclosure includes an automatic driver configured to drive fasteners through apertures in a shingle. In one embodiment, the automatic driver is configured to drive a fastener into a roof deck such that a head of the fastener is between approximately ⅜ inch and approximately 9/16 inch from the roof deck. In one embodiment, the fastener has a standard 10 gauge shank and a length of approximately 1.5 inches. Optionally, the fastener can have a length that is less than approximately 1.6 inches. The fastener can be comprised of copper, stainless steel, bronze, or brass. In another embodiment, the automatic driver is set to drive a fastener to the shallowest depth. In one embodiment, the automatic driver is connected to a source of air compressed to approximately 80 PSI, or optionally less than 80 PSI. In one embodiment, the automatic driver is a nail gun.

The nail gun generally includes a body, a trigger assembly, and a depth adjustment assembly. The trigger assembly is operable to activate a driver configured to drive fasteners into a roof deck. The depth adjustment assembly can include a regulating member operable to alter a force applied by the driver to a fastener. In this manner, the depth adjustment assembly can be used to a depth the fastener will be driven into the roof deck. The regulating member can be rotatable, such as a knob. In one embodiment, the nail gun is a model DW45RN Roofing Coil Nailer manufactured by DeWalt. The depth setting of the Nailer may be set to "1".

One aspect of the present disclosure is a shingle configured to be hung to a roof by a fastener driven by a nail gun. The shingle comprises: (1) an upper end opposite a lower end, the upper and lower ends defining a length; and (2) at least one aperture through the shingle, the at least one aperture positioned no more than 3 inches from the upper end. Optionally, the length is from approximately 8 inches to approximately 14 inches. In one embodiment, the shingle has a thickness of less than approximately 0.8 inches. Additionally, or alternatively, the shingle can be formed of at least one of slate, ceramic, glass, clay, or concrete. Another aspect is a roof including at least one shingle, the at least one shingle hung from the roof by a fastener driven by a nail gun. Another aspect is a nail gun configured to hang the shingle to a roof.

Another aspect of the present disclosure is a method of installing shingles on a roof. The method generally includes, but is not limited to, one or more of: (1) positioning an underlayment on a roof deck of the roof; (2) aligning a starter strip proximate to a lower end of the roof deck; (3) affixing an interlayment to the roof deck over the starter strip and the underlayment; (4) aligning a first course of shingles with a lower end of the interlayment; (5) driving fasteners from a nail gun through apertures in at least one of the shingles of the first course of shingles; and (6) overlapping the first course of shingles with a second interlayment and a second course of shingles affixed to the roof deck. The method may further include overlapping a shingle of the first course of shingles by positioning a lower end of a shingle of the second course of shingles not more than approximately 4 inches from an upper end of the shingle of the first course.

In one embodiment, the aperture of the shingle is positioned no more than 3 inches from an upper end of the shingle. In another embodiment, the shingle has a thickness of less than about 0.8 inches. Optionally, the fastener has a length of approximately 1.5 inches. Additionally, or alternatively, the length of the fastener can be less than approximately 1.5 inches. In one embodiment the nail gun drives the fastener into the roof deck such that a head of the fastener is between approximately ⅜ inch and approximately 9/16 inch from (or above) the roof deck. In this manner, the nail gun is operable to drive the fastener into the roof deck through the aperture without damaging the shingle. More specifically, by driving the fastener such that the head is between approximately ⅜ inch and approximately 9/16 inch from the roof deck, the head of the fastener will not apply an excessive force to the shingle. The method can also include connecting the nail gun to a source of air compressed to less than approximately 100 PSI.

The method can optionally include overlapping the second course of shingles with a third interlayment and a third course of shingles affixed to the roof deck. In one embodiment, at least one of the shingles of the second course of shingles is fastened to the roof deck by a fastener driven from the nail gun. Lower ends of shingles of the third course of shingles can be a predetermined distance from upper ends of shingles of the first course of shingles. In this manner, the shingles of the third course of shingles do not overlap the shingles of the first course of shingles.

These and other advantages will be apparent from this disclosure. The above-described embodiments, objectives, and configurations are neither complete nor exhaustive. As will be appreciated, other embodiments are possible using, alone or in combination, one or more of the features set forth above or described below. For example, it is contemplated that various features and devices shown and/or described with respect to one embodiment may be combined with or substituted for features or devices of other embodiments regardless of whether or not such a combination or substitution is specifically shown or described herein. Further, this Summary is neither intended nor should it be construed as representing the full extent and scope of the present disclosure. The present disclosure is set forth in various levels of detail in the Summary, and, in the attached drawings and the Detailed Description and no limitation as to the scope of the present disclosure is intended to either the inclusion or non-inclusion of elements, components, etc. in this Summary. Additional aspects of the present disclosure will become more readily apparent from the detailed description, particularly when taken with the drawings.

Although various dimensions are provided to illustrate exemplary embodiments, it is expressly contemplated that dimensions may be varied and still comport with the scope and spirit of the present disclosure. Unless otherwise indicated, all numbers expressing quantities, dimensions, conditions, ratios, ranges, and so forth used in the specification and claims are to be understood as being modified in all instances by the term "about" or "approximately". Accordingly, unless otherwise indicated, all numbers expressing quantities, dimensions, conditions, ratios, ranges, and so forth used in the specification and claims may be increased or decreased by approximately 5% to achieve satisfactory results. In addition, all ranges described herein may be reduced to any sub-range or portion of the range, or to any value within the range without deviating from the invention.

The terms "shingle" and "tile" may be used interchangeably and are each intended to cover roofing materials of any type or shape formed of any suitable material. For example, a shingle or tile of the present disclosure can be formed of, but is not limited to: slate, clay, concrete, ceramic, glass, and wood or similar products.

BRIEF DESCRIPTION OF THE DRAWINGS

The accompanying drawings, which are incorporated in and constitute a part of the specification, illustrate embodiments of the present disclosure and together with the general description given above and the detailed description of the drawings given below, serve to explain the principles of these embodiments. It should be understood that the drawings are not necessarily to scale. In certain instances, details which are not necessary for an understanding of the disclosure or which render other details difficult to perceive may have been omitted. The present disclosure is not necessarily limited to the particular embodiments illustrated herein.

Figure 1:
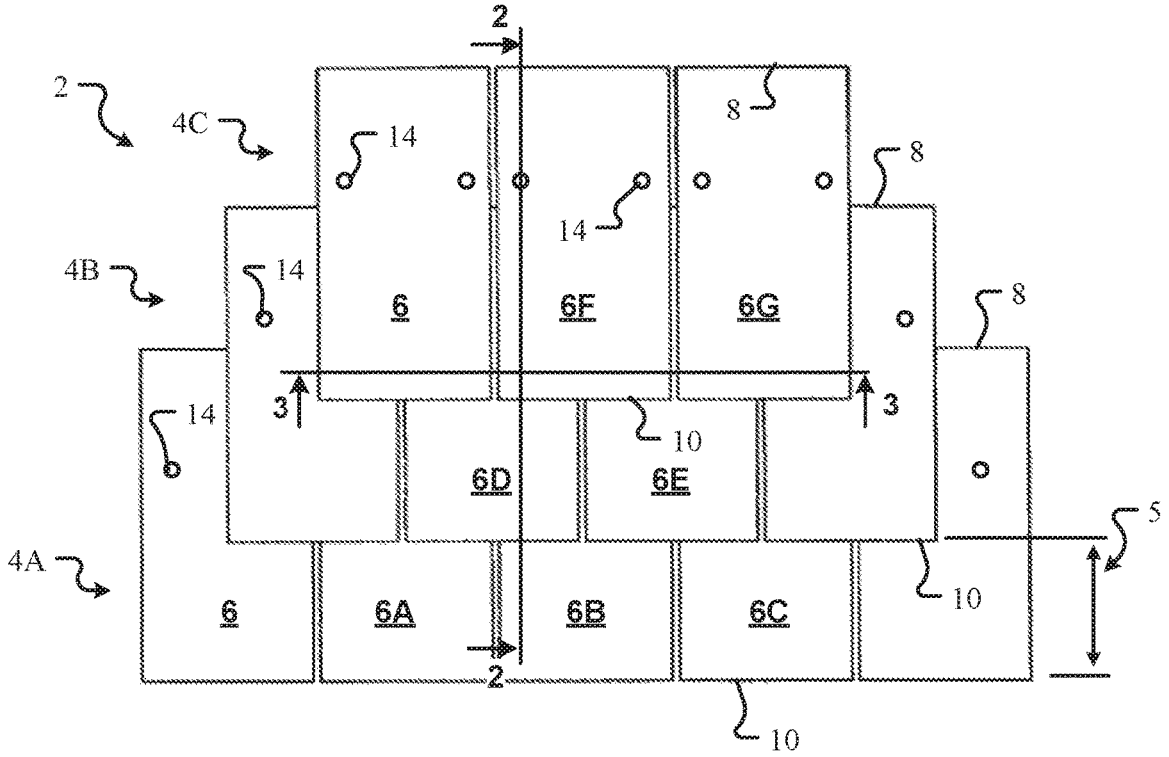
Fig. 1 (Prior Art)
FIG. 1 is a top plan view of a prior art slate shingle roof.

To assist in the understanding the present disclosure, a list of components and associated numbering found in the drawings is provided herein:

NUMBER COMPONENT

2 Roof deck
4 Courses
5 Exposure
6 Shingle
8 Shingle upper end
10 Shingle lower end
11 Upper surface of shingle
12 Lower surface of shingle
14 Fastener
16 Shingle thickness
18 Air gap
20 Roof
22 Roof deck
24 Courses
26 Overlap
27 Exposure
28 Starter strip
30 Interlayment material
32 Lower end of interlayment
34 Shingle or tile
36 Upper end
38 Lower end
40 Length
42 Width
44 Aperture
46 Distance from upper end to aperture

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, the phraseology and terminology used herein is for the purpose of description and should not be regarded as limiting. The use of "including," "comprising," or "having" and variations thereof is meant to encompass the items listed thereafter and equivalents thereof as well as additional items.

Figure 4:
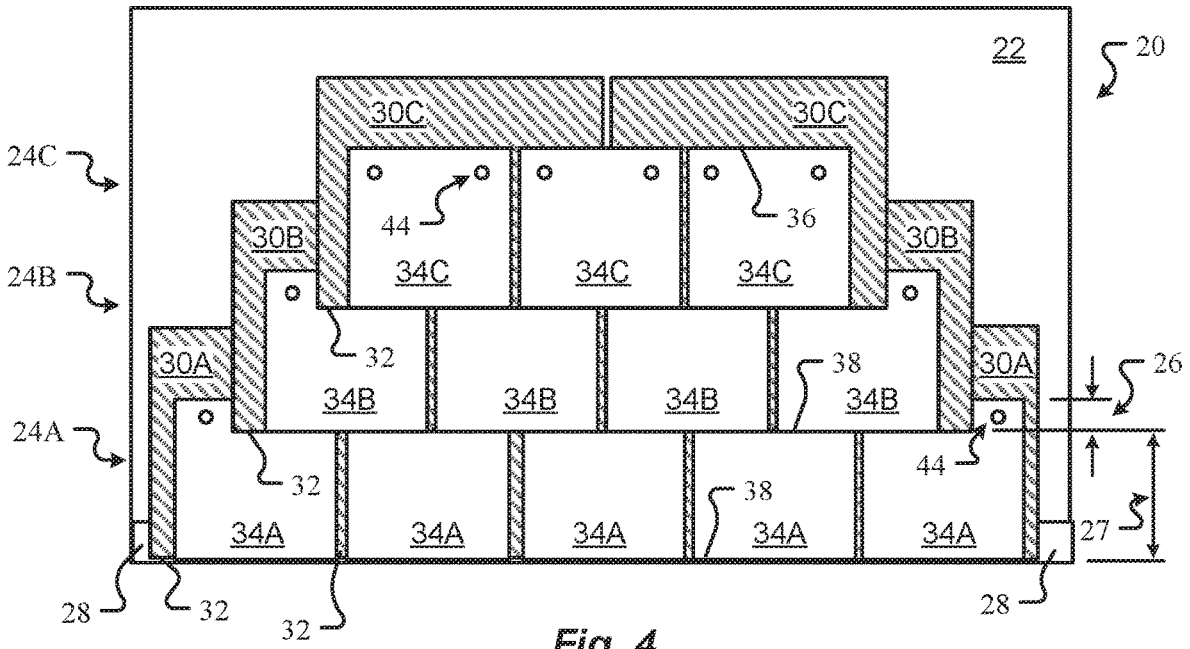
FIG. 4 is a top plan view of a shingle roof of the present disclosure.

Referring now to FIG. 4, a roof 20 including shingles 34 of the present disclosure is illustrated. The roof 20 is installed by a method of the present disclosure. The method includes driving fasteners by a nail gun through shingles 34. An underlayment, such as felt, may cover the roof deck 22. A starter strip 28 of approximately the thickness of a shingle 34 is positioned under the first course 24A.

A sheet of interlayment 30A is affixed to the roof deck 22 over the starter strip 28. Suitable interlayment is known to those of skill in the art. The interlayment 30 may be of any desired size. In one embodiment, the interlayment 30 is approximately 12 inches to 18 inches long. The interlayment 30 can be cut to any appropriate width. The interlayment 30 has a thickness of between approximately 20 and 60 mil. In one embodiment, the interlayment 30 is approximately 30 mil thick.

The interlayment 30 may be a plastic material and may comprise a thermoplastic elastomer or a high-density polyethylene such as used in geomembrane barriers. Optionally, a rubber roofing membrane may be used as the interlayment 30. Additionally, or alternatively, the interlayment 30 may comprise one or more of: thermoplastic olefin, high-density polyethylene, thermoplastic elastomers, ethylenepropylene diene monomer, polypropylene, and styreneethylene-butadiene-styrene, and similar materials.

A first course 24A of shingles 34A is positioned over the interlayment 30A. A lower end 38 of the shingles 34A is positioned about even with, or slightly overlapping (such as by about ⅛" to about ¼") the lower end 32 of the interlayment 30A. The shingles 34A are fastened or hung from the roof deck 22 by driving fasteners, such as nails, through apertures 44 formed in the shingles 34A. Unlike prior art shingles 6 describe above, the fasteners can be driven through the shingle apertures 44 by automatic driving means, such as nail guns. Accordingly, fasteners are driven by a nail gun through an aperture of at least one of the shingles 34A.

The fasteners have a shank that is shorter than fasteners used with prior art shingles of the same thickness. In one embodiment, the fastener has a standard 10 gauge shank and a length of approximately 1.5 inches. Optionally, the fastener is formed of one of copper, stainless steel, bronze, or brass.

In one embodiment, the nail gun is connected to a source of air compressed to 80 PSI. The nail gun is set to drive the fastener head not closer than approximately 9/16 inches from the roof deck. Suitable nail guns are known to those of skill in the art. To provide additional background, context, and to further satisfy the written description requirements of 35 U.S.C. § 112, the following references are incorporated by reference herein in their entireties: U.S. Pat. Nos. 5,593,079, 5,873,510, 6,783,045, 6,929,165, and 8,550,324. Optionally, the nail gun is a model DW45RN Roofing Coil Nailer manufactured by DeWalt and available at: https://www.dewalt.com/products/power-tools/nailers-and-staplers/framing-and-roofing-nailers/coil-roofing-nailer/dw45rn. When driving the fasteners through the single apertures, the depth setting of the DeWalt Nailer can be set to "1".

A second course 24B is then positioned on the roof 20. Interlayment 30B of the second course 24B is positioned to overlap 26 the upper end 36 of the shingles 34A of the first course 24A by a predetermined amount. In one embodiment, the overlap 26 is between approximately 2.5 inches and approximately 4 inches. However, the amount of overlap 26 may be greater.

The shingles 34 have an exposure 27 that is greater than prior art shingles 6 of a similar length. In one embodiment, the exposure 27 is between approximately 8 inches and approximately 9.5 inches when the shingle length 40 is approximately 12 inches. Other exposures 27 are contemplated for use with the shingles 34 of the present disclosure. In one embodiment, the exposure 27 is equal to the length 40 minus the overlap 26. In contrast, for a prior art shingle 6, the exposure 5 is the length of the shingle minus the overlap which is then divided by two.

Shingles 34B of the second course 24B are hung from the roof deck 22 in a manner similar to the first course 24A. Thus, at least one shingle 34B of the second course is hung by a fastener driven by a nail gun. A third course 24C and additional courses can then be added as necessary in a similar manner with alternating layers of interlayment 30 and shingles 34.

Using shingles 34 of the present disclosure hung to a roof deck 22 with an automatic driving means typically reduces installation time by at least about 40% or up to approximately 50%. For example, two experienced craftsman can generally hang about 5 squares of slate tiles or shingles 6 (or sufficient slate to cover about 500 square feet) per day by manually driving nails through the shingles. In contrast, using shingles 34 of the present disclosure, two experienced craftsman can hang about 10 squares of shingles 34 (or 1,000 square feet) per day by using nail guns to drive fasteners through the shingles 34.

Figure 5:
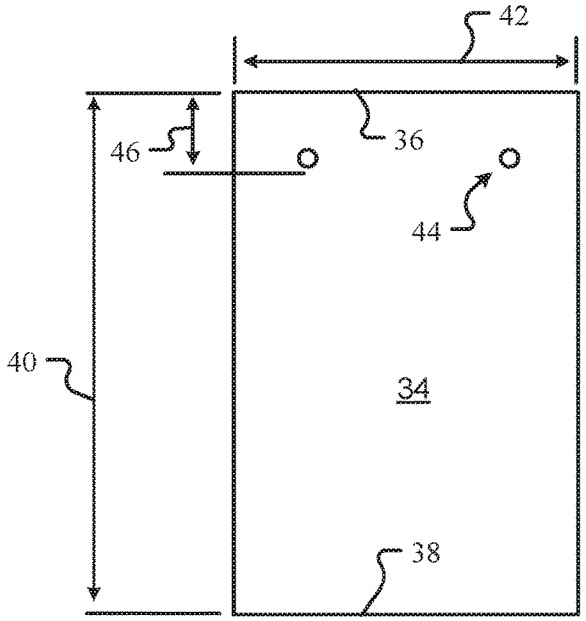
FIG. 5 is a top plan view of a shingle of the present disclosure.

Referring now to FIG. 5, a shingle 34 of the present disclosure is illustrated. The shingle 34 can be formed from slate. Alternatively, the shingle 34 or tile can be formed of clay, concrete, ceramic, glass, wood, or similar products.

The shingle 34 generally includes an upper end 36 and a lower end 38 defining a length 40. The shingle 34 may have any desired length. In one embodiment, the length 40 is between approximately 8 inches and approximately 14 inches. In another embodiment, the length 40 is approximately 12 inches. In this manner, when affixed to a roof, the shingle 34 may be used in a course having at least an 8 inch exposure 27 and an overlap 26 over a previous course of shingles by up to about 4 inches.

The shingle 34 may have any desired width 42. In one embodiment, the width 42 is between approximately 6 inches and approximately 12 inches. In another embodiment, the width 42 is approximately 8 inches. However, the tiles or shingles 34 of the present disclosure can have any appropriate width.

In one embodiment, the shingle 34 is not greater than approximately 1 inch thick. In another embodiment, the shingle 34 has a thickness of between approximately 0.25 inch and 0.375 inch.

The shingle 34 includes apertures 44 to receive fixtures to hang the shingle to a roof deck 22. The apertures 44 are positioned less than ⅓ of the length 40 of the shingle from the upper end 36. More specifically, the distance 46 the apertures are spaced from the upper end 36 is less than the distance separating an aperture of a prior art shingle 6 from the shingle upper end 8. The fixtures can be driven by an automatic driving means, such as a nail gun. The apertures 44 may be formed by drilling or punching through the shingle 34.

Figure 2:
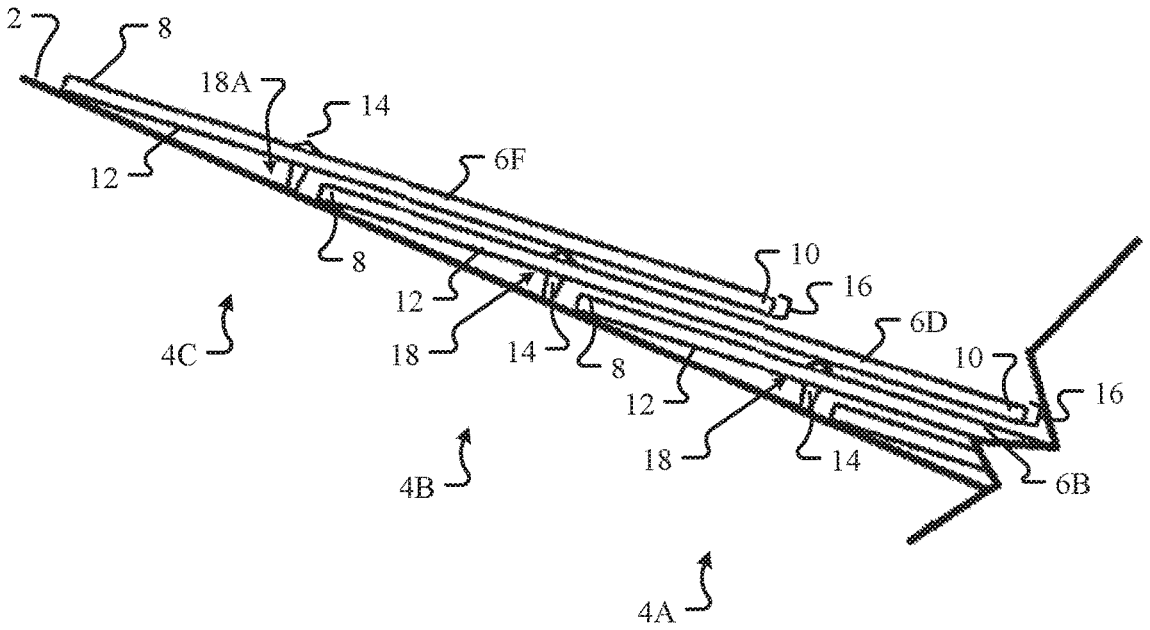
Fig. 2 (Prior Art)
FIG. 2 is a partial cross-sectional side elevation view of the roof of FIG. 1 taken along line 2-2.
Figure 3:
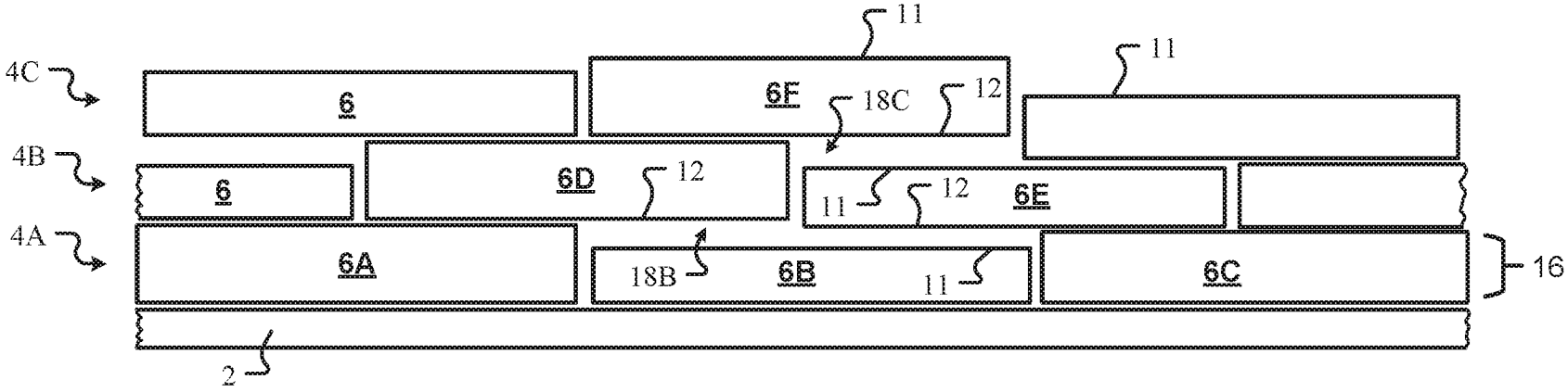
Fig. 3 (Prior Art)
FIG. 3 is a partial cross sectional front elevation view of the roof of FIG. 1 taken along line 3-3.

The applicant has found that by moving the position of the aperture 44 closer to the shingle upper end 36 and by increasing the exposure 27, the angle between a lower surface of the shingle 34 and the roof deck 22 is decreased compared to prior art shingles. The height of an air gap between the lower surface of the shingle 34 and the roof deck 22 is also decreased compared to prior art shingles. More specifically, the air gap of a shingle 34B in an upper course 24B is reduced to less than approximately 50% of the thickness of the overlapped shingles 34A of a lower course 24A. Reducing the height of the air gap between the shingle and the roof deck seats the shingle 34 closer to the roof deck. The shingle 34 experiences less uneven pressure, and less stress, during installation of a fastener. In contrast, as described in conjunction with FIGS. 1-3, in a prior art shingle 6, an air gap 18 is approximately equal to the thickness of overlapped shingles 6 of a lower course. Further, because the shingle 34 is closer to the roof deck at the point of the aperture 44, the length of a fastener used to fix the shingle 34 to the roof deck can be decreased compared to the fasteners required for prior art shingles of a similar thickness. Shorter fasteners generally require less force to drive into the roof deck compare to the 1.75 inch fasteners 14 specified for use with the prior art shingles 6. Accordingly, shorter fasteners, for example having a length of approximately 1.5 inches, can be driven by an automatic driving means, such as a nail gun.

In one embodiment, the apertures 44 are formed a distance 46 of no more than approximately 3 inches from the upper end 36. In another embodiment, the apertures 44 are between approximately 1.75 inches and approximately 2.5 inches from the upper end 36. In still another embodiment, the apertures 44 are positioned no closer than approximately 2.75 inches from the upper end 36.

Other shingles and systems and methods of installing them are described in the following references which are each incorporated herein in their entirety by reference: UK Application GB 15,872 to Chilcott; UK Application GB 120,454 to Morris; UK Application GB 126,589 to Fletcher; UK Application GB 2,277,540 by Cooke; UK Application GB 2,335,670 by Harris; U.S. Pat. No. 4,914,885 by Baker; and PCT Publication WO 01/65024 by Beckett.

While various embodiments of the present disclosure have been described in detail, it is apparent that modifications and alterations of those embodiments will occur to those skilled in the art. However, it is to be expressly understood that such modifications and alterations are within the scope and spirit of the present disclosure, as set forth in the following claims. Further, the embodiment(s) described herein is capable of other embodiments and of being practiced or of being carried out in various ways.

What is claimed is:

1. A method of installing a roof, comprising:

positioning an underlayment on a roof deck of the roof;

aligning a starter strip proximate to a lower end of the roof deck;

affixing an interlayment to the roof deck over the starter strip and the underlayment;

aligning a first course of slate shingles with a lower end of the interlayment;

driving a nail from a nail gun through an aperture in a slate shingle of the first course of slate shingles, wherein the nail has a length of no more than approximately 1.5 inches and the nail gun drives the nail into the roof deck such that a head of the nail is between approximately ⅜ inch and approximately 9/16 inch from the roof deck, wherein the slate shingle has a thickness of less than approximately 0.5 inches and has a length of from approximately 8 inches to approximately 14 inches, and wherein the aperture is positioned between approximately 1.75 inches and approximately 3 inches from an upper end of the slate shingle; and overlapping the first course of slate shingles with a second interlayment and a second course of slate shingles affixed to the roof deck.

2. The method of claim 1, wherein the nail has a 10 gauge shank.

3. The method of claim 1, wherein the aperture of the slate shingle is positioned between approximately 2.75 inches and approximately 3 inches from the upper end of the slate shingle.

4. The method of claim 1, wherein the slate shingle has a thickness of between approximately 0.125 inches and approximately 0.5 inches.

5. The method of claim 1, further comprising overlapping a slate shingle of the first course of slate shingles by positioning a lower end of a slate shingle of the second course of slate shingles not more than approximately 4 inches from the upper end of the slate shingle of the first course.

6. The method of claim 1, further comprising overlapping the second course of slate shingles with a third interlayment and a third course of slate shingles affixed to the roof deck, wherein lower ends of slate shingles of the third course of slate shingles are a predetermined distance from upper ends of slate shingles of the first course of slate shingles.

7. The method of claim 6, wherein the slate shingles of the third course of slate shingles do not overlap the slate shingles of the first course of slate shingles.

8. The method of claim 1, further comprising connecting the nail gun to a source of air compressed to less than approximately 100 PSI.

9. The method of claim 1, wherein the slate shingle is formed of hand split natural slate.

10. The method of claim 9, wherein the slate shingle has a thickness of at least approximately ⅛ inch.

11. The method of claim 10, wherein the aperture is positioned between approximately 1.75 inches and approximately 2.75 inches from the upper end.

12. The method of claim 1, wherein the aperture is positioned less than one-third of a length of the slate shingle from the upper end.

13. The method of claim 1, wherein the aperture is positioned at least approximately 2.75 inches from the upper end.

14. The method of claim 1, wherein the nail comprises one of copper, stainless steel, bronze, or brass.

15. A method of installing a roof, comprising:

positioning an underlayment on a roof deck of the roof;

aligning a starter strip proximate to a lower end of the roof deck;

affixing an interlayment to the roof deck over the starter strip and the underlayment;

aligning a slate shingle of a first course of slate shingles with a lower end of the interlayment, the slate shingle formed of hand split natural slate, wherein the slate shingle has a thickness of between approximately 0.125 inches and approximately 0.5 inches and a length of from approximately 8 inches to approximately 14 inches, and wherein an aperture is positioned between approximately 1.75 inches and approximately 3 inches from an upper end of the slate shingle;

connecting a nail gun to a source of air compressed to less than approximately 100 PSI;

driving a nail from the nail gun through the aperture in the slate shingle of the first course of slate shingles, wherein the nail has a length of no more than approximately 1.5 inches and the nail gun drives the nail into the roof deck such that a head of the nail is between approximately ⅜ inch and approximately 9/16 inch from the roof deck; and overlapping the first course of slate shingles with a second interlayment and a second course of slate shingles affixed to the roof deck.

16. The method of claim 15, wherein the aperture is positioned between approximately 1.75 inches and approximately 2.75 inches from the upper end.

17. The method of claim 15, wherein the aperture is positioned between approximately 2.75 inches and approximately 3 inches from the upper end.

18. The method of claim 15, wherein the nail comprises one of copper, stainless steel, bronze, or brass and has a 10 gauge shank.

* * * * *